US010962013B2

(12) United States Patent
Davis et al.

(10) Patent No.: US 10,962,013 B2
(45) Date of Patent: Mar. 30, 2021

(54) REGENERATIVE TURBINE PUMPS

(71) Applicant: Ebs-Ray Pumps Pty Ltd, Cromer (AU)

(72) Inventors: James Jay Davis, Davidson (AU); John Cosgrove, Mosman (AU); Stephen Basclain, Thornleigh (AU); Malcolm Malone, Mona Vale (AU); Jonathan Gough, Concord West (AU)

(73) Assignee: Ebs-Ray Pumps Pty Ltd, Cromer (AU)

( * ) Notice: Subject to any disclaimer, the term of this patent is extended or adjusted under 35 U.S.C. 154(b) by 247 days.

(21) Appl. No.: 15/854,215

(22) Filed: Dec. 26, 2017

(65) Prior Publication Data

US 2019/0195229 A1 Jun. 27, 2019

(51) Int. Cl.
*F04D 5/00* (2006.01)

(52) U.S. Cl.
CPC ..... *F04D 5/007* (2013.01); *F05B 2250/31* (2013.01); *F05B 2250/503* (2013.01); *F05D 2250/52* (2013.01)

(58) Field of Classification Search
CPC ..... F04D 5/002; F04D 5/007; F04D 5/008
USPC ..... 415/55.2
See application file for complete search history.

(56) References Cited

U.S. PATENT DOCUMENTS

| | | | | |
|---|---|---|---|---|
| 2,842,062 | A * | 7/1958 | Wright | F04D 15/0011 415/11 |
| 5,348,442 | A | 9/1994 | Harris et al. | |
| 5,413,457 | A | 5/1995 | Tuckey | |
| 5,702,229 | A | 12/1997 | Moss et al. | |
| 6,068,456 | A | 5/2000 | Tuckey et al. | |
| 6,190,119 | B1 | 2/2001 | Roth et al. | |
| 6,296,439 | B1 | 10/2001 | Yu et al. | |
| 6,439,833 | B1 | 8/2002 | Pickelman et al. | |
| 6,942,446 | B2 * | 9/2005 | Penzar | F04D 5/006 415/101 |
| 7,198,455 | B2 * | 4/2007 | Downham | F04D 23/008 415/55.1 |
| 2004/0079081 | A1 | 4/2004 | Jevons | |
| 2005/0013689 | A1 * | 1/2005 | Racer | F04D 29/708 415/206 |
| 2012/0071702 | A1 | 3/2012 | Butler | |
| 2015/0104288 | A1 * | 4/2015 | Lin | F04D 5/008 415/1 |

FOREIGN PATENT DOCUMENTS

| | | | | |
|---|---|---|---|---|
| GB | 2506722 A * | 4/2014 | | G01F 1/10 |

* cited by examiner

*Primary Examiner* — Ninh H. Nguyen
*Assistant Examiner* — Cameron A Corday
(74) *Attorney, Agent, or Firm* — Fish & Richardson P.C.

(57) ABSTRACT

Turbine pumps can include: an inlet port; a first discharge port; a body defining a flow path extending from the inlet port through a raceway to the discharge port; and a turbine impeller disposed in the raceway. In some pumps, the body further defines an channel providing a fluid connection between a raceway outlet and the discharge port. In some pumps, an outlet angle defined by the inlet port, an axis of the turbine, and the discharge port is between 30 and 180 degrees.

27 Claims, 6 Drawing Sheets

REGENERATIVE TURBINE PUMPS

TECHNICAL FIELD

This invention relates to pumps, and more particularly to regenerative turbine pumps.

BACKGROUND

Regenerative turbine pumps fill a need between centrifugal and positive displacement designs. They combine high discharge pressure of displacement types with the flexible operation of centrifugal pumps. Regenerative turbine pumps are also known as vortex, peripheral and regenerative pumps.

SUMMARY

A regenerative turbine pump can include a channel or channels providing a fluid connection between an outlet of a raceway of the pump and an outlet port of the pump. The channel allows the pump to be configured in an efficient design with an inlet to the raceway positioned near the raceway outlet while substantially separating the inlet port and the outlet port of the pump. The resulting design flexibility facilitates the use of regenerative turbine pumps in a broad range of applications.

In some aspects, turbine pumps include: an inlet port; a first discharge port; a body defining a flow path extending from the inlet port through a raceway to the discharge port; and a turbine impeller disposed in the raceway; wherein the body further defines an annular channel providing a fluid connection between a raceway outlet and the discharge port.

In some aspects, turbine pumps include: an inlet port; a discharge port; a body defining a flow path extending from the inlet port (e.g., from a centerline of the inlet port) through a raceway to the discharge port; and a turbine disposed in the raceway; wherein the body further defines a channel providing a fluid connection between a raceway outlet and the discharge port; and wherein an outlet angle defined by the inlet port, an axis of the turbine, and the discharge port is between 30 and 180 degrees. For purposes of this disclosure, ranges are understood to be inclusive of the stated end values of a given range.

Embodiments of pumps can include one or more of the following features.

In some embodiments, an outlet angle defined by a centerline of the inlet port, an axis of the turbine impeller, and the discharge port is between 30 and 180 degrees. In some cases, the outlet angle is between 45 and 180 degrees. In some cases, the outlet angle is between 90 and 180 degrees.

In some embodiments, the annular channel is parallel to the raceway.

In some embodiments, the annular channel is a first annular channel and the pump further comprises a second annular channel. In some cases, the raceway is disposed between the first annular channel and the second annular channel.

In some embodiments, pumps also include a second discharge port. In some cases, pumps also include a bypass valve.

In some embodiments, pumps also a shaft mechanically connected to the turbine impeller. In some cases, the shaft is disposed on a line defined between the inlet port and the first discharge port.

In some embodiments, a raceway outlet angle defined by a centerline of the inlet port, an axis of the turbine impeller, and the raceway outlet is less than 90 degrees. In some cases, the raceway outlet angle is less than 45 degrees.

In some embodiments, the channel provides two flow paths between the raceway outlet and the discharge port. In some cases, the channel is an annular channel parallel to the raceway.

Embodiments of the pumps can provide one or more of the following advantages.

Regenerative turbine pumps with a channel, particularly an annular channel, which provides a fluid connection between an outlet of the raceway and the discharge port of the pump, allow the outlet port of the pump to be placed independently of the inlet port of the pump. For example, pumps incorporating a channel or channels providing a fluid connection between an outlet of a raceway of the pump and an outlet port of the pump can be formed with different inlet and discharge port orientations. This flexibility allows regenerative turbine pumps to be used in applications such as, for example, the unloading of liquefied petroleum gas (LPG) tank trucks, which are poorly configured for pumps with a pump inlet adjacent a pump outlet.

This flexibility also allows the pumps to be designed to match the port/shaft/3D centerline or footprint of other pumps such as, for example, commercially available vane pumps. However, regenerative turbine pumps only one moving hydraulic component that does not contact other component of the pump. In contrast, vane pumps have as many as ten moving, hydraulic components that are in high contact load with other parts of the pumps.

For similar wear related reasons, regenerative turbine pumps have a service life that is up to 5-10 times greater than positive displacement pumps. In addition, regenerative turbine pumps have little difference between normal operating noise and noise when the pump is operating in cavitation conditions. In contrast, positive displacement pumps are very noisy when operating in cavitation conditions.

The described regenerative turbine pumps are very easy to service as disassembly and re-assembly are simplified. The pumps can be re-handed as per the customer requirements if any last minute installation conflicts occur.

The described regenerative turbine pumps also have reduced production costs due to casting weight savings due to the annular channels that reduce raw material costs.

The details of one or more pumps are set forth in the accompanying drawings and the description below. Other features, objects, and advantages of the pumps will be apparent from the description and drawings, and from the claims.

DESCRIPTION OF DRAWINGS

Like reference symbols in the various drawings indicate like elements.

DETAILED DESCRIPTION

A regenerative turbine pump can include a channel or channels providing a fluid connection between an outlet of a raceway of the pump and an outlet port of the pump. The channel allows the pump to be configured in an efficient design with an inlet to the raceway positioned near the raceway outlet while substantially separating the inlet port and the outlet port of the pump. The resulting design flexibility facilitates the use of regenerative turbine pumps in a broad range of applications.

Figure 1:
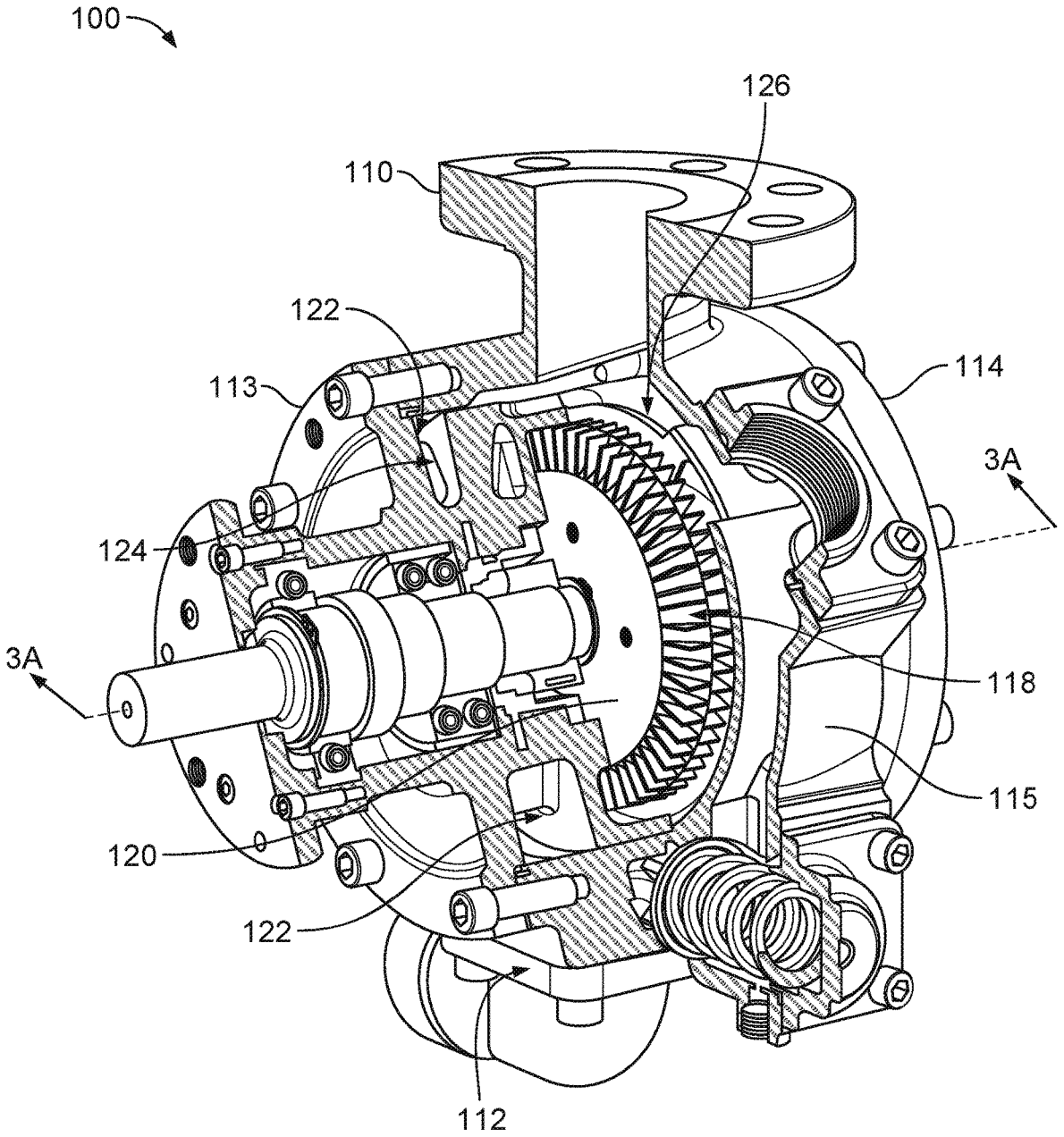
FIG. 1 is a partially cutaway view of a regenerative turbine pump.

FIG. 1 shows a regenerative turbine pump 100 in which an inlet port 110 is on an opposite side of the pump 100 from a discharge port 112. A casing includes a bearing housing 113, a cover 114, and a body. The casing defines an internal flow path 116 (see FIG. 2) extending from the inlet port 110 through a raceway 118 to the discharge port 112. A turbine impeller 120 is disposed in the raceway 118.

The bearing housing 113 and cover 114 are disposed in the body 115. The body 115 provides the inlet port 110 and the discharge port 112 as well as an alternate inlet port and a bypass valve housing. The bearing housing 113 and the cover 114 of the pump 100 each define a channel 122 laterally offset from the raceway 118 that provides a fluid connection between an outlet 124 of the raceway (the raceway outlet) and the discharge port 112. In the pump 100, the channel 122 is an annular channel and, consequently, two parts of the one channel are visible in FIG. 1. The channel 122 is parallel to the raceway 118. As used herein, "parallel" is used to indicate features that are generally aligned. This usage includes but does not require a configuration in which lines/planes extending through the features never intersect.

The relationship between the bearing housing 113, the cover 114, and the pump body 115 makes the position of the inlet to the raceway 118 and channels 122 (contained within the bearing housing 113 and cover 114) independent of the body. This configuration of the channel 122 provides significant design flexibility to the pump.

Figure 8:
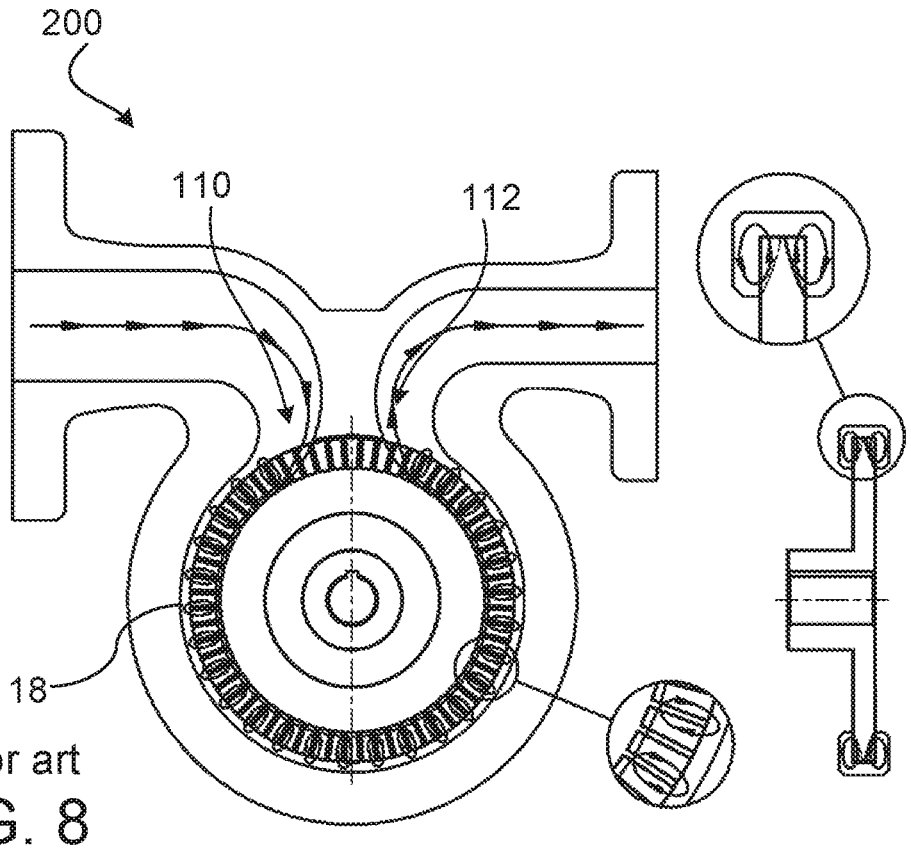
Prior art FIG. 8
FIG. 8 is a schematic view of a regenerative turbine pump.

Regenerative turbine pumps are mechanically similar to centrifugal pumps but have performance characteristics like those of a positive displacement pump. The impeller turbine 118 has multiple blades. When the impeller turbine is properly installed, the blades approach but do not contact inner surfaces of the raceway. Like centrifugal pumps, regenerative turbine pumps pressurize fluid by accelerating the fluid to convert kinetic energy to potential energy. However, regenerative turbine pumps break the acceleration/pressurization process into many separate steps slightly accelerating and pressurizing the fluid with each step. The impeller picks up fluid entering the raceway of a regenerative pump and induces the fluid to make a spiraling motion around the circumference of each side of the impeller with each spiral representing an acceleration/pressurization cycle as shown in FIG. 8.

Due to these characteristics, a regenerative turbine pump perform best when the inlet to and outlet from the raceway are close together. In conventional regenerative turbine pumps as shown in FIG. 8, the inlet port 110 of the pump 200 is the inlet to the raceway and the outlet port 112 of the pump is the outlet of the raceway and, consequently, the inlet port of the pump and the outlet port of the pump are positioned close together. When aligned inlet and outlet ports are desired, the conventional approach is to offset the shaft from the centerline of the ports as shown in FIG. 8.

The channel 122 allows the pump 100 to be configured with an inlet 126 to the raceway positioned near the raceway outlet 124 while substantially separating the inlet port 110 and the outlet port 112 of the pump 100. The channel 122 allows the outlet port of the pump to be placed independently of the inlet port of the pump. Although the inlet port 110 and the outlet port 112 are on opposite sides of the pump 100, some pumps have different port configurations.

Figure 2:
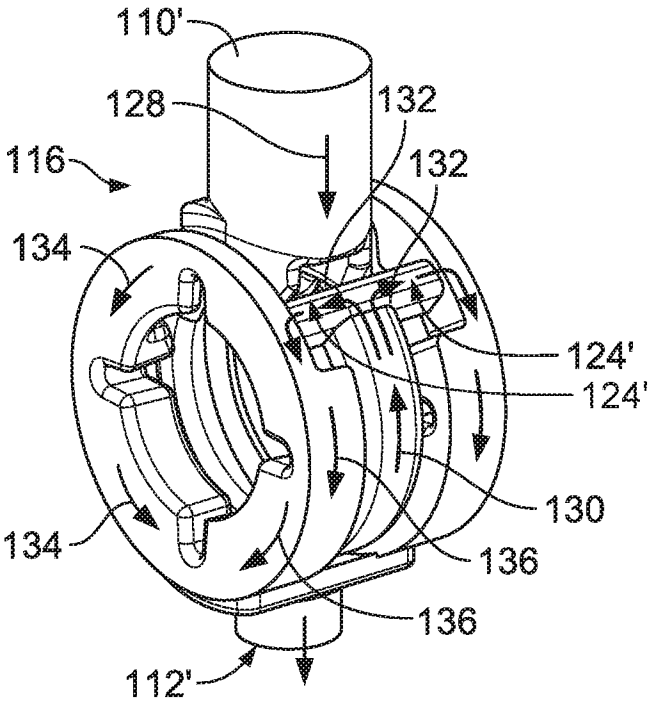
FIG. 2 is a schematic view of the fluid flow through the pump of FIG. 1.

FIG. 2 is a schematic view of fluid flow through the pump 100 of FIG. 1. The flow path 116 is illustrated by showing contours of fluid in the flow path with arrows indicating the direction fluid flows when the pump 100 is operating. The following description of fluid flow through the pump 100 refers to the pump components shown in FIG. 1 and the fluid and flow directions shown in FIG. 2.

Fluid entering the pump 100 flows downward through the inlet port 110 as indicated by arrow 128. Terms such as "downward", "upward", "top", "bottom", "clockwise", and "anticlockwise" are used to indicate position, orientation, and/or direction in the frame of reference of the figures and do not imply any absolute position, orientation, or direction. At the bottom of the inlet port 110, the fluid passes through an inlet ramp (not shown) into an inlet of the raceway 118. The inlet ramp is located in the back of the illustrated flow path and is not visible in this view. Rotation of the turbine impeller 120 causes the fluid to flow through the raceway 118 as indicated by arrow 130. The fluid exits the raceway 118 at the raceway outlet 124 as indicated by arrows 132.

Although only the bearing housing 113 channel 122 is visible in FIG. 1, the cover 114 of the pump 100 defines a second channel 122. As can be seen in FIG. 2, both channels 122 are annular channels. The term "annular" is used to indicate that these channels are generally ring-shaped in configuration. The channels 122 vary in dimension between the raceway outlet 124 and the outlet port 112. The raceway 118 is disposed between the first annular channel 122 and the second annular channel 122.

Each channel 122 provides two flow paths between the raceway outlet 124 and the discharge port 112. A portion of the fluid flows flow counter-clockwise as indicated by arrows 134 and a portion of the fluid flows flow clockwise as indicated by arrows 136. The fluid from each channel 122 flows out the pump through the outlet port 112.

Although pump 100 defines two annular channels 122, some pumps have different channel configurations such as pumps with only a single annular channel and pumps with arc-shaped channels that do not extend 360 degrees to form an annular channel. For example, a pump with arc-shaped channels that extend 180 degrees can provide a discharge port in the same position relative to the inlet port as the discharge port 112 of the pump 100.

Figure 3A:
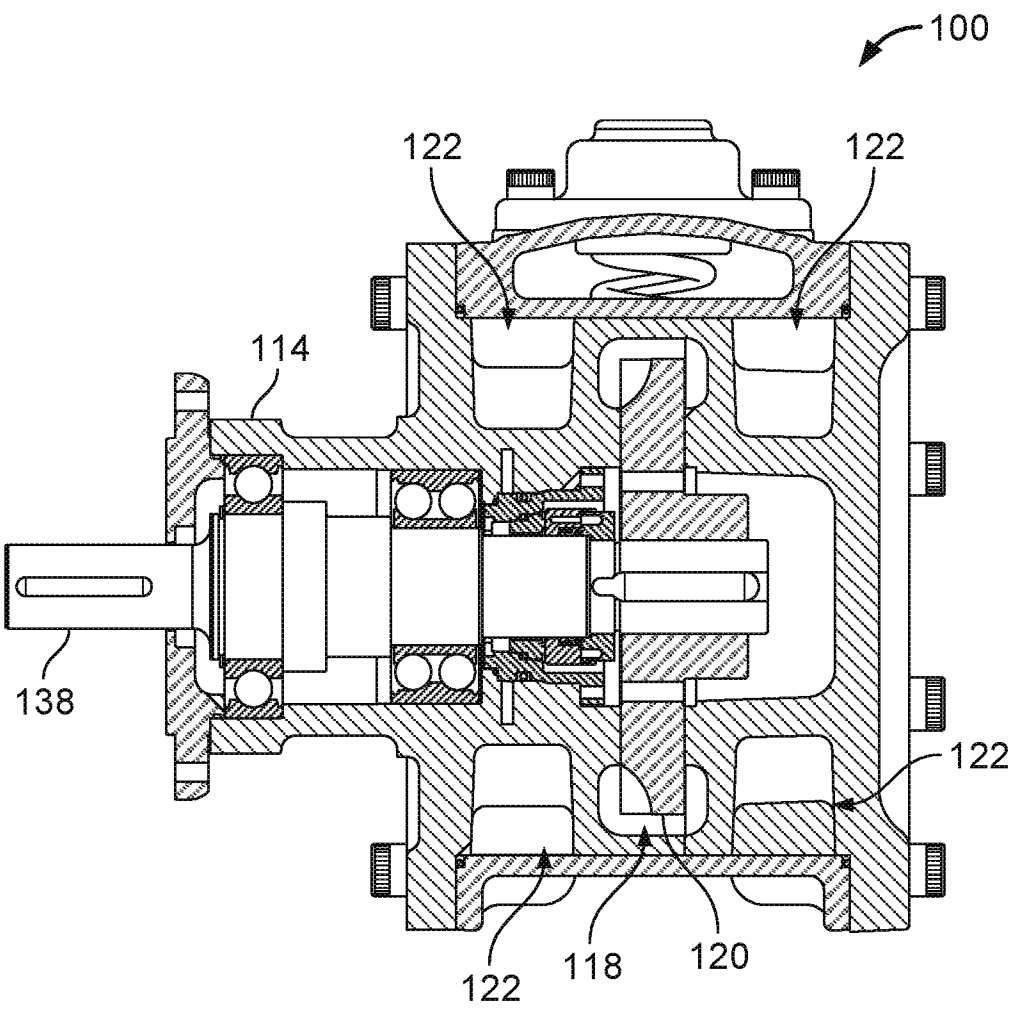
FIG. 3A is a cross-section of the pump of FIG. 1 taken in a plane perpendicular to an axis of the pump.
Figure 3C:
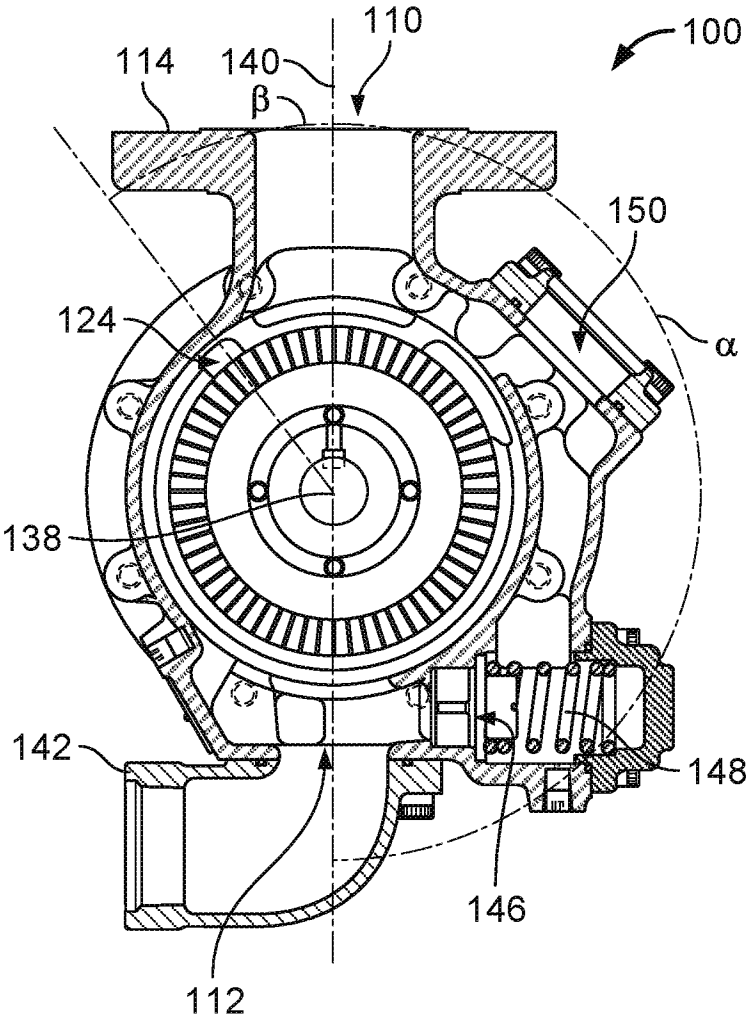
FIGS. 3B and 3C are cross-sections of the pump of FIG. 1 taken in a plane along the axis of the pump.
Figure 3B:
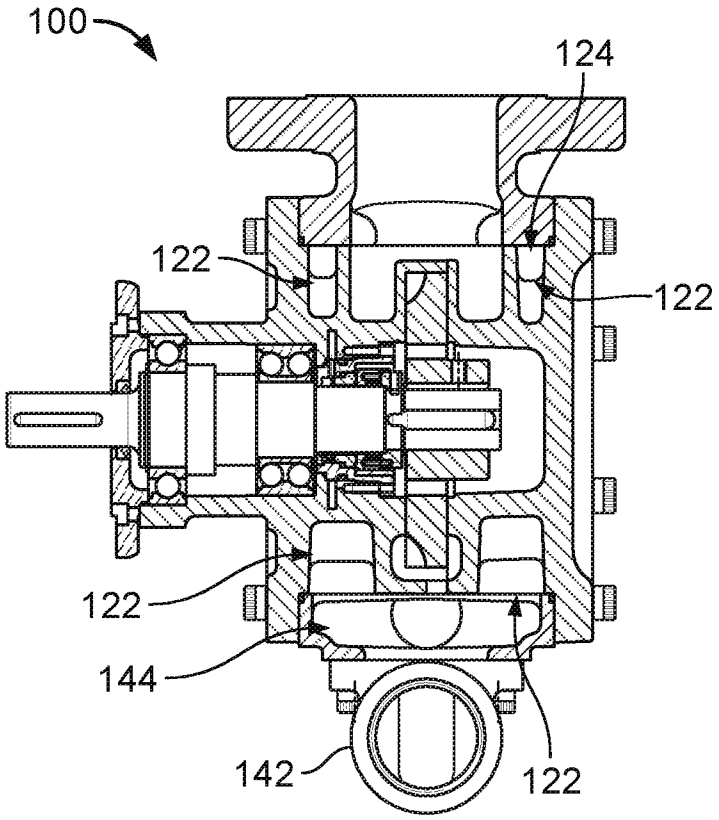

FIG. 3A is a cross-section of the pump of FIG. 1 taken in a plane perpendicular to an axis of the pump 100. FIGS. 3B and 3C are cross-sections of the pump of FIG. 1 taken in a plane along the axis of the pump 100. These figures show additional features of the pump 100 and more clearly show some of the features discussed with respect to FIG. 1.

A shaft 138 supports the turbine impeller 120 in the raceway 118. The shaft 138 is mechanically connected to the turbine impeller 120 such that rotation of the shaft causes rotation of the turbine impeller 120. The shaft 138 is disposed on a line 140 (see FIG. 3C) defined between an axis of the inlet port 110 and an axis of the outlet port 112. An elbow 142 is attached to the body 114 of the pump 100 to redirect fluid passing through the outlet port 112. The elbow 142 is provided to match pipe work of a particular installation and is not always present.

As previously discussed, the two channels 122 defined by the bearing housing 113 and the cover 114. The raceway outlet 124 (see FIG. 3C) discharges into a narrow portion of each of the channels 122. The channels 122 increase in size as they approach a manifold 144 (see FIG. 3B). The change in size can be seen best by comparing the portions of the channels 122 on the upper portion of FIG. 3B with the portion of the channels on the lower portion of FIG. 3B. In addition to providing a flow path between the raceway outlet 124 and the outlet port 112, the channels 122 are voids and reduce the weight of the pump 100.

The manifold 144 combines the flow from both of the channels 122 for discharge through the discharge port 122. Pumps with only a single channel connecting the raceway typically do not include a manifold.

The position of the discharge port can be characterized by an outlet angle α defined by a centerline of the inlet port 110, an axis of the turbine impeller 138, and the discharge port 112. As previously discussed, channels that provide a fluid connection between the raceway outlet and the discharge port of a pump, allow the outlet port of the pump to be placed independently of the inlet port of the pump. This configuration enables pumps to be manufactured with outlet angles α between 0 and 180 degrees. The outlet angle α (see FIG. 3C) of the pump 100 is 180 degrees. Some pumps with channels that provide a fluid connection between the raceway outlet and the discharge port of the pumps have outlet angles α between 30 and 180 degrees (e.g., between 45 and 180 degrees or between 90 and 180 degrees).

This flexibility allows the regenerative turbine pump 100 in applications where the relative positions of the pump inlet port, the alternate inlet port, and the discharge port prevent the efficient use of conventional regenerative turbine pumps. For example, the positions of the pump inlet port, the alternate inlet port, the discharge port, and the shaft have become part of a quasi-industrial standard for pumps used in unloading of LPG tank trucks. The separation of the inlet port and the outlet port allows the regenerative turbine pump 100 to be used in this application. Similarly, the design flexibility provided by a regenerative turbine pump with independently positioned inlet and outlet ports allows the regenerative turbine pumps described in this disclosure to be configured to match the port/shaft/3D centerline or footprint of other pumps such as, for example, commercially available vane pumps.

The pump 100 has a secondary discharge port 146 controlled by a bypass valve 148 that releases fluid from the pump when pressure exceeds set levels. The bypass valve 148 contains a valve and a bypass spring. The spring has a working length and becomes active or shortens when the pumps internal discharge pressure exceeds predetermined levels. When the valve opens the fluid being pumped recirculates to the inlet until the discharge pressure drops and the valve re-seats.

Some pumps have alternate inlet ports. The pump 100 has an alternate inlet port 150. The alternate inlet port 150 can be used, for example, when the pump is required to empty an external tank for internal inspection.

Figure 4B:
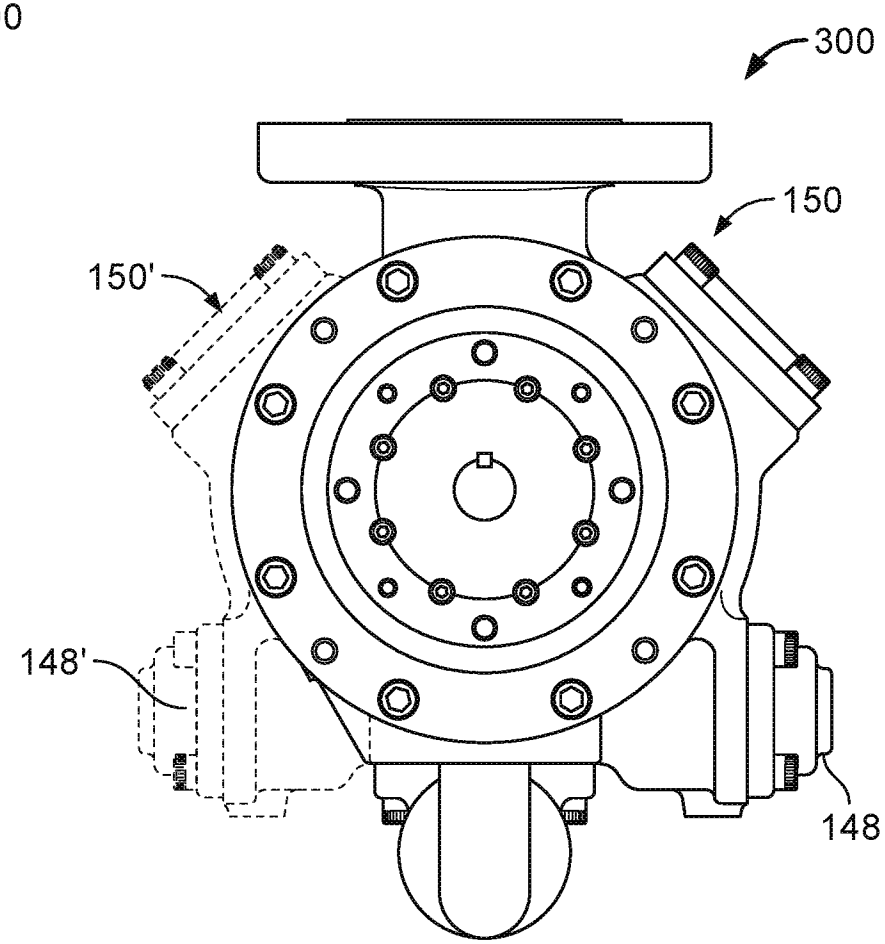
FIG. 4A and FIG. 4B are, respectively, a side view and an end view of the pump of FIG. 1.
Figure 4A:
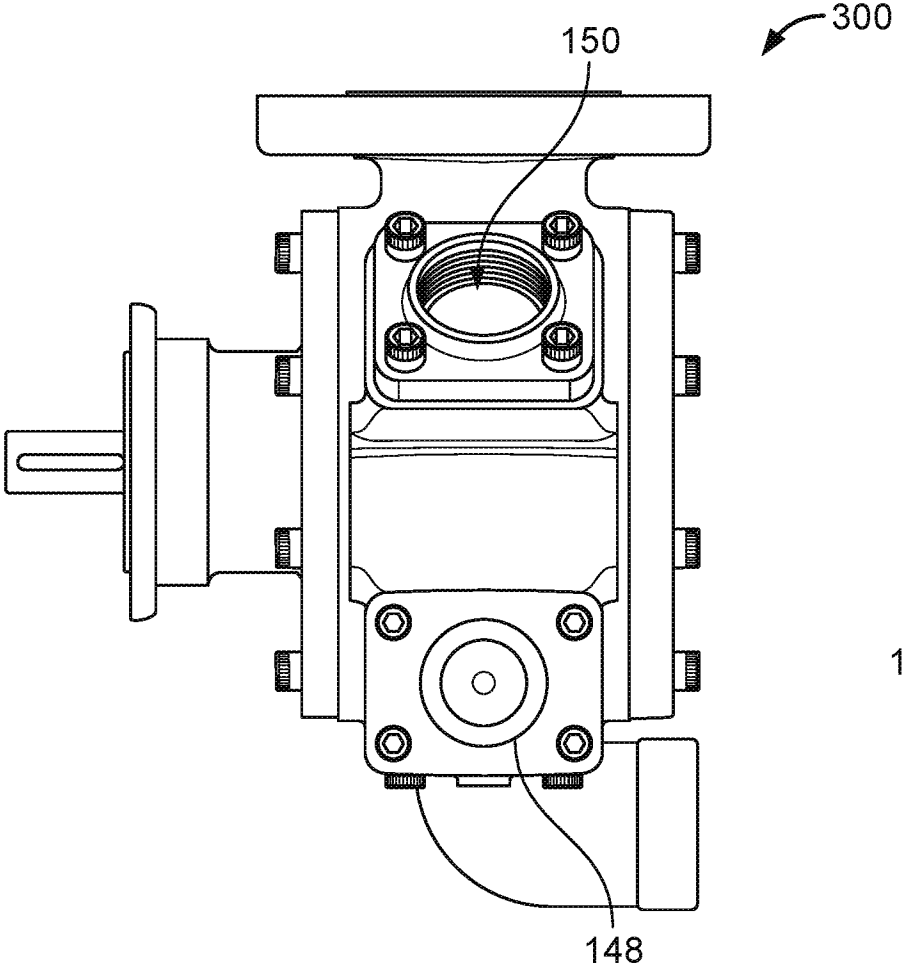

Some pumps can be labelled as left or right handed when viewing the drive shaft with the pumps inlet port facing upwards. The alternate inlet and bypass valve indicate the handing of the pump. FIGS. 4A and 4B show a right handed pump. FIG. 4B indicates a left handed option in dotted lines.

Pumps can also be described by the position of the raceway outlet relative to the inlet port which can be characterized by a raceway outlet angle β defined by a centerline of the inlet port, an axis of the turbine impeller, and the raceway outlet. This design enables pumps to be manufactured with raceway outlet angles β between 0 and 180 degrees. The raceway outlet angle β (see FIG. 3C) of the pump 100 is ~50 degrees. Some pumps have raceway outlet angles β less than 90 degrees (e.g., less than 60 degrees or less than 45 degrees).

Figure 5:
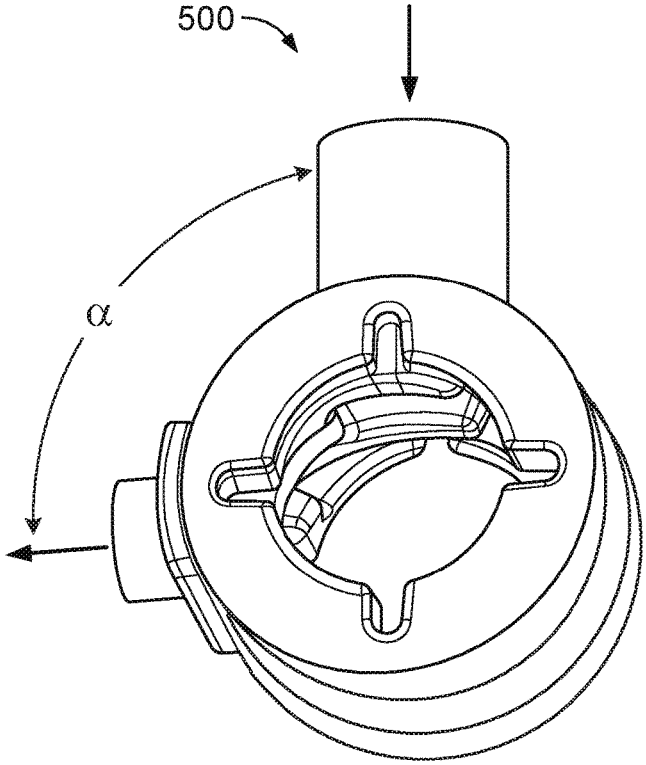
FIG. 5-7 are perspective views of a regenerative turbine pumps.
Figure 6:
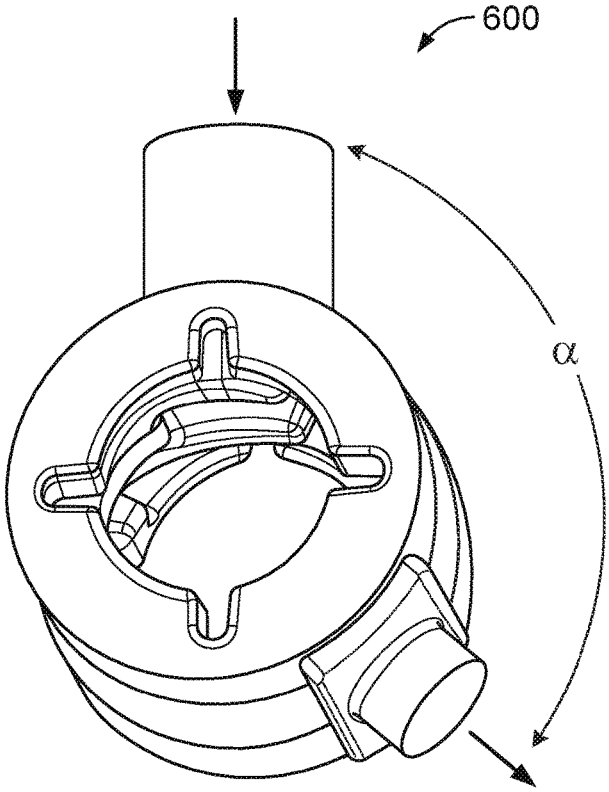
Figure 7:
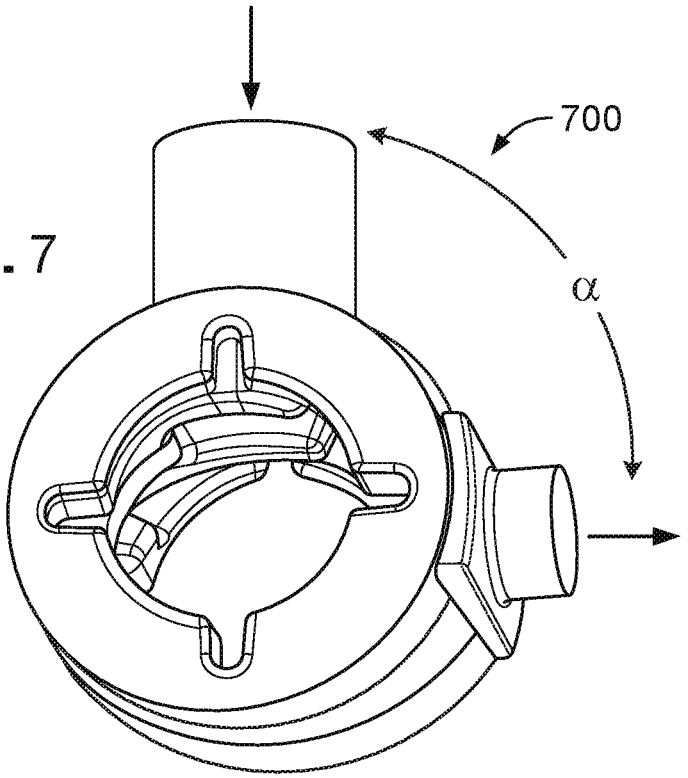

A number of embodiments of the invention have been described. Nevertheless, it will be understood that various modifications may be made without departing from the spirit and scope of the invention. For example, pumps incorporating a channel or channels providing a fluid connection between an outlet of a raceway of the pump and an outlet port of the pump can be formed with different orientations or numbers of ports. FIG. 4A and FIG. 4B show a pump 300 in which the bypass valve and secondary inlet port are on the opposite side of their location on pump 100. Channels 122 allow for this by swapping the bearing housing 113 and cover 114. FIGS. 5-7 show regenerative turbine pumps with different discharge port options allowed for by the use of the channels 122. FIG. 5 shows a regenerative turbine pump 500 with an outlet angle α of 90 degrees. FIG. 6 shows a regenerative turbine pump 600 with an outlet angle α of 135 degrees. FIG. 7 shows a regenerative turbine pump 700 with an outlet angle α of 90 degrees in the opposite orientation of the pump 500 shown in FIG. 5. Accordingly, other embodiments are within the scope of the following claims.

What is claimed is:

1. A regenerative turbine pump comprising:

an inlet port of the pump;

a discharge port of the pump;

a housing defining a flow path extending from the inlet port of the pump through a raceway channel to the discharge port of the pump, wherein the raceway channel extends from an inlet of the raceway channel to an outlet of the raceway channel; and a turbine impeller disposed in the raceway channel;

wherein the housing further defines an annular channel providing a fluid connection between the outlet of the raceway channel and the discharge port of the pump, the annular channel comprising a first annular channel and a second annular channel, wherein the raceway channel is disposed between the first annular channel and the second annular channel; and wherein a raceway outlet angle defined by a centerline of the inlet port, an axis of the turbine impeller, and a centerline of the outlet of the raceway channel is less than 90 degrees.

2. The pump of claim 1, wherein an outlet angle of the pump defined by the centerline of the inlet port, the axis of the turbine impeller, and a centerline of the discharge port of the pump is between 30 and 180 degrees.

3. The pump of claim 2, wherein the outlet angle of the pump is between 45 and 180 degrees.

4. The pump of claim 3, wherein the outlet angle of the pump is between 90 and 180 degrees.

5. The pump of claim 1, further comprising a cover defining a flow path extending from the inlet port of the pump through the raceway channel to the discharge port of the pump.

6. The pump of claim 1, wherein the annular channel and the raceway channel are concentric.

7. The pump of claim 1, wherein the annular channel is a first annular channel and the pump further comprises a second annular channel.

8. The pump of claim 7, wherein the raceway channel is disposed between the first annular channel and the second annular channel.

9. The pump of claim 1, further comprising an alternate inlet port of the pump.

10. The pump of claim 9, further comprising a bypass valve.

11. The pump of claim 1, further comprising a shaft mechanically connected to the turbine impeller.

12. The pump of claim 11, wherein the shaft is disposed on a line defined between the inlet port of the pump and the discharge port of the pump.

13. The pump of claim 1, wherein the raceway outlet angle is less than 45 degrees.

14. The pump of claim 13, further comprising a shaft mechanically connected to the turbine impeller.

15. The pump of claim 14, wherein the shaft is disposed on a line defined between the inlet port of the pump and the discharge port of the pump.

16. The pump of claim 13, wherein the raceway outlet angle is less than 45 degrees.

17. The pump of claim 1, wherein (i) the centerline of the inlet port of the pump is collinear with a centerline of the discharge port of the pump and (ii) the centerline of the inlet port of the pump and the centerline of the discharge port of the pump passes through the axis of the turbine impeller.

18. The pump of claim 1, wherein the annular channel is laterally offset from the raceway channel.

19. The pump of claim 1, wherein the annular channel extends 360 degrees to form a closed annular channel.

20. A regenerative turbine pump comprising:

an inlet port of the pump;

a discharge port of the pump;

a body defining a flow path extending from the inlet port of the pump through a raceway channel to the discharge port of the pump, wherein the raceway channel extends from an inlet of the raceway channel to an outlet of the raceway channel; and a turbine impeller disposed in the raceway channel;

wherein the body further defines a channel providing a fluid connection between the outlet of the raceway channel and the discharge port of the pump, wherein the channel is laterally offset from the raceway channel;

wherein a raceway outlet angle defined by a centerline of the inlet port, an axis of the turbine impeller, and a centerline of the outlet of the raceway channel is less than 90 degrees; and wherein an outlet angle of the pump defined by the centerline of the inlet port, the axis of the turbine impeller, and a centerline of the discharge port is between 30 and 180 degrees; wherein the channel extends 360 degrees to form a closed channel.

21. The pump of claim 20, wherein the outlet angle of the pump is between 45 and 180 degrees.

22. The pump of claim 21, wherein the outlet angle of the pump is between 90 and 180 degrees.

23. The pump of claim 20, wherein the channel provides two flow paths between the outlet of the raceway channel and the discharge port of the pump.

24. The pump of claim 23, wherein the channel is an annular and concentric to the raceway channel.

25. The pump of claim 20, wherein (i) the centerline of the inlet port of the pump is collinear with a centerline of the discharge port of the pump and (ii) the centerline of the inlet port of the pump and the centerline of the discharge port of the pump passes through the axis of the turbine impeller.

26. The pump of claim 20, wherein the channel comprises a first channel and a second channel and wherein the raceway channel is disposed between the first channel and the second channel.

27. A regenerative turbine pump comprising:

an inlet port of the pump;

a discharge port of the pump;

a housing defining a flow path extending from the inlet port of the pump through a raceway channel to the discharge port of the pump, wherein the raceway channel extends from an inlet of the raceway channel to an outlet of the raceway channel; and a turbine impeller disposed in the raceway channel;

wherein the housing further defines an annular channel providing a fluid connection between the outlet of the raceway channel and the discharge port of the pump, wherein the annular channel extends 360 degrees to form a closed annular channel; and wherein a raceway outlet angle defined by a centerline of the inlet port, an axis of the turbine impeller, and a centerline of the outlet of the raceway channel is less than 90 degrees.

* * * * *